US005103539A

United States Patent [19]

Adlon et al.

[11] Patent Number: 5,103,539

[45] Date of Patent: Apr. 14, 1992

[54] INSERTION HEAD FOR A WIRE TRIMMING AND INSERTING MACHINE

[75] Inventors: Daniel T. Adlon, Harrisburg; Richard V. Spong, Etters, both of Pa.

[73] Assignee: AMP Incorporated, Harrisburg, Pa.

[21] Appl. No.: 335,073

[22] Filed: Apr. 7, 1989

[51] Int. Cl.[5] ..... H01R 43/00

[52] U.S. Cl. ..... 29/33 F; 29/748; 29/566.3

[58] Field of Search ..... 29/33 M, 566.1, 753, 29/749, 748, 861, 865, 866, 566.4, 566.3, 751; 279/46 A, 44; 83/389; 81/9.41; 140/139, 123.6

[56] References Cited

U.S. PATENT DOCUMENTS

| | | | |
|---|---|---|---|
| 3,322,013 | 5/1967 | Felix | 83/460 |
| 3,798,734 | 3/1974 | Fedor | 29/566.3 |
| 4,232,443 | 11/1980 | Lichtenstein et al. | 29/753 |
| 4,318,215 | 3/1982 | Holt | 29/749 X |
| 4,380,433 | 4/1983 | Ellman et al. | 279/46 A X |
| 4,627,150 | 12/1986 | Burnett | 29/751 X |
| 4,642,874 | 2/1987 | Litehizer | 29/749 X |

FOREIGN PATENT DOCUMENTS

| | | |
|---|---|---|
| 0007711 | 6/1979 | European Pat. Off. . |
| 0063908 | 4/1982 | European Pat. Off. . |
| 0147081 | 11/1984 | European Pat. Off. . |
| 0167985 | 7/1985 | European Pat. Off. . |

OTHER PUBLICATIONS

European Search Report.

*Primary Examiner*—Larry I. Schwartz
*Assistant Examiner*—Robert Schultz

[57] ABSTRACT

The insertion head of the present invention is for a wire trimming and inserting machine, i.e., a machine or apparatus for loading color-coded, or otherwise coded wires into a connector half. It includes a platform with an appendage coupled thereto. The appendage has a channel formed therein to receive and guide wire therethrough to a terminal of a connector half. The insertion head includes a spring biased guide, which bears against the channel-received wire, and imposes a movement-retarding force or drag on the wire to insure that the latter is held taut until engaged with the connector terminal.

9 Claims, 3 Drawing Sheets

INSERTION HEAD FOR A WIRE TRIMMING AND INSERTING MACHINE

FIELD OF THE INVENTION

The present invention relates to machines or apparatus for loading wires into a connector half, automatically, where the wires are randomly arranged and each wire is identified and inserted into a desired terminal, and in particular to an insertion head, for such a machine or apparatus, for moving wires into connector terminals while severing the wires to appropriate lengths.

BACKGROUND OF THE INVENTION

Multiple, color-coded or otherwise coded wire cable, such as telephone communications cable, consists of an outer sheath covering a number of pairs, such as twenty-five, of insulated color-coded wires. Pairs of the wires may be twisted together to reduce cross talk. Lengths of the cable are assembled with a male connector half at one end and a female connector half at the opposite end to accommodate use thereof in communications apparatus.

U.S. Pat. Nos. 4,470,181 and 4,238,874, issued in September 1984 to Sergeant, and December 1980 to Chandler et al. respectively, disclose novel apparatus for automatically sorting individual wires from groups of twisted pairs of wires, in a communications cable, and for trimming and connecting the wires, in a desired arrangement, in a solderless electrical connector half. In the patented apparatus, each wire, in turn, is passed to a pair of friction drive rollers which apply tension thereto. A ram moves each wire lengthwise of the rollers and into a throat of a trimming and insert mechanism where it is met with another ram which cuts the wire to length and inserts the cut end into a terminal of a connector half.

SUMMARY OF THE INVENTION

The present invention includes an insertion head for a wire trimming and inserting machine for inserting wire into a connector terminal. The head includes a platform having a variable-width channel means coupled thereto for receiving and guiding a wire therethrough. Means is provided for positioning the connector terminal and the variable-width channel into mutual alignment. Further means is provided for moving the wire through the variable-width channel and into engagement with the terminal. The variable-width channel includes means for imposing a movement-retarding force or drag on the wire during movement of the wire through the channel.

OBJECTS OF THE INVENTION

An object of the invention is to provide an insertion head, for a wire trimming and inserting machine, comprising a platform; and means coupled to the platform defining a variable-width channel for receiving wire therewithin and guiding such wire in movement thereof through the channel; wherein the channel-defining means includes means for imposing a movement-retarding force or drag on channel-received and -guided wire during movement of the wire in the channel.

It is a further object of this invention to provide an insertion head, for a wire trimming and inserting machine, having a platform; and an appendage coupled to the platform; wherein the appendage has a channel formed therein for receiving wire therewithin and guiding the wire in movement thereof through the channel from a first position to a second position; and means coupled to the appendage for imposing a movement-retarding force or drag on channel-received and -guided wire during movement of the wire between the two positions.

Still further objects of this invention, as well as the novel features thereof, will become more apparent by reference to the following description taken in conjunction with the accompanying figures, in which.

DETAILED DESCRIPTION

Figure 1:
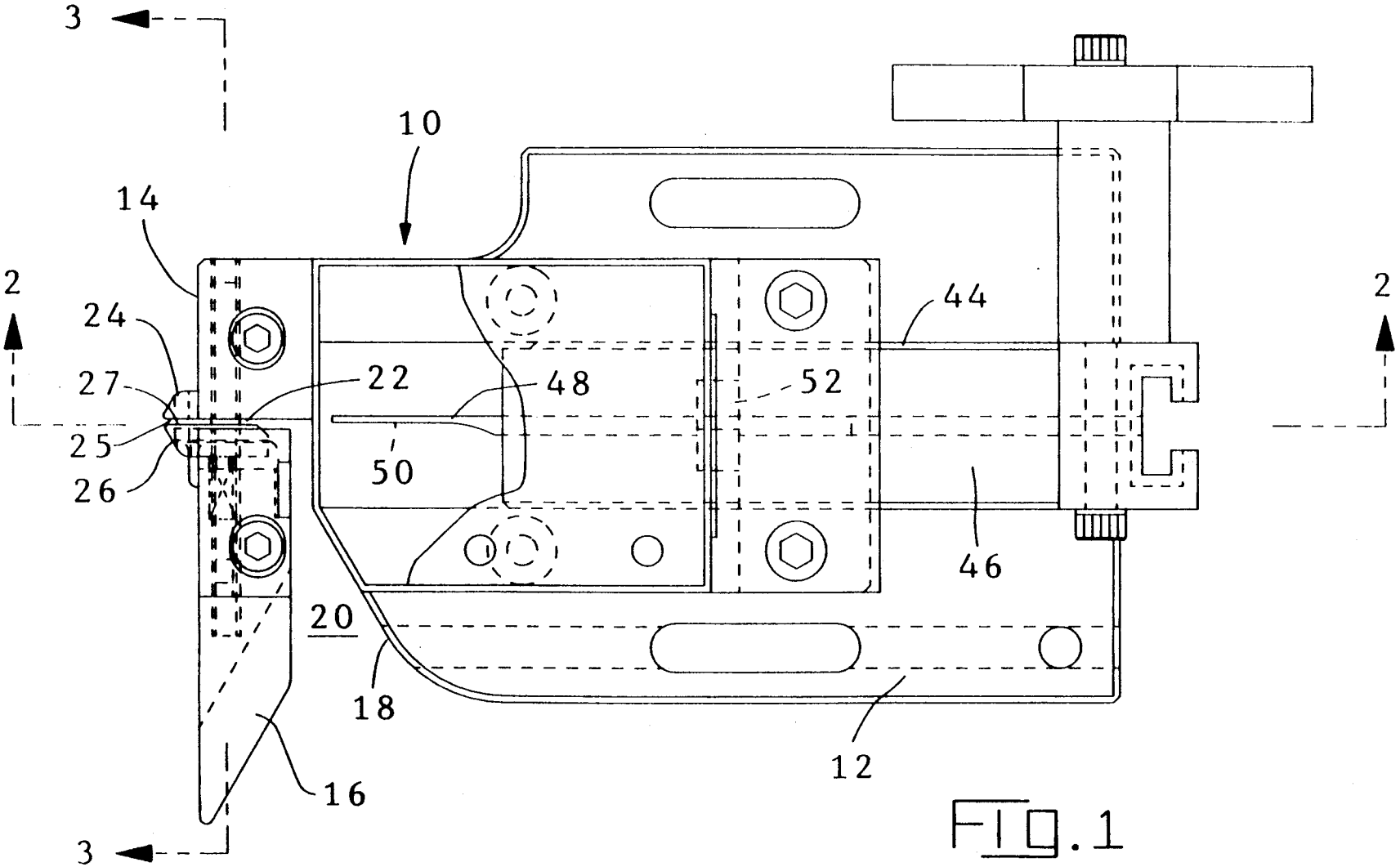
FIG. 1 is a plan view, partially cut-away, of a preferred embodiment of the insertion head according to the invention.

As shown in the figures, the novel insertion head 10 comprises a platform 12 having an appendage 14 coupled thereto. The insertion head 10 corresponds, generally, to the wire trimming and inserting mechanism disclosed in the aforesaid U.S. Pat. Nos. 4,470,181 and 4,238,874. For the purposes of this disclosure, and for a fuller understanding of the ancillary apparatus, the aforesaid patents are hereby incorporated by reference as if set forth verbatim herein.

Platform 12, as will be understood from the aforesaid patents, is coupled to an apparatus which sorts out individual wires from twisted pairs thereof and conveys them to the cited wire trimming and inserting mechanism. The patented apparatus has means for moving wires, individually, to friction drive rollers. The rollers apply a tension to the individual wire while a ram moves the tensioned wire into the throat of the wire trimming and inserting mechanism.

Each wire, necessarily, must be disposed at an inclination from the vertical, upon entry into the throat, and moved transverse to the length thereof for severing and engagement with the contact of a connector half. In such movement, of course, the effective length of the wire, between the drive rollers and the trimming and inserting mechanism, must include an amount of slack as will be described below. To insure that there is a wire dress of neat and orderly appearance, after all wires have been set in their respective contacts, and to assure lateral control of the wire a movement-retarding force or drag is imposed on the wires as each is moved from the throat to its designated contact.

The appendage 14 has a wing 16 which, with the adjacent, angular surface 18 of the platform defines a wire entry throat 20. The throat 20 terminates at, and opens into, a channel 22, which is approximately normal thereto. The channel 22 is formed by a first, fixed guide 24 which has a linear surface defining a first wall 25 of the channel. A second guide 26 is movably mounted in the appendage 14, and also has a linear surface which confronts the linear surface of the fixed guide 24 and defines a second wall 27 of the channel 22. Guide 26 also has a shank 28 which is slidably held in guideways formed in an underlying member 30 and an innermost, clamping end 32 of the wing 16. The guide 26 further has a shoulder 34 which confronts a recess 36 formed in the member 30. A compression spring 38 nests in the recess 36 to bear against the shoulder 34 and urge the guide 26 toward its companion guide 24. The aforesaid first and second walls 25 and 27 of the guides 24 and 26 define the channel 22.

Figure 2:
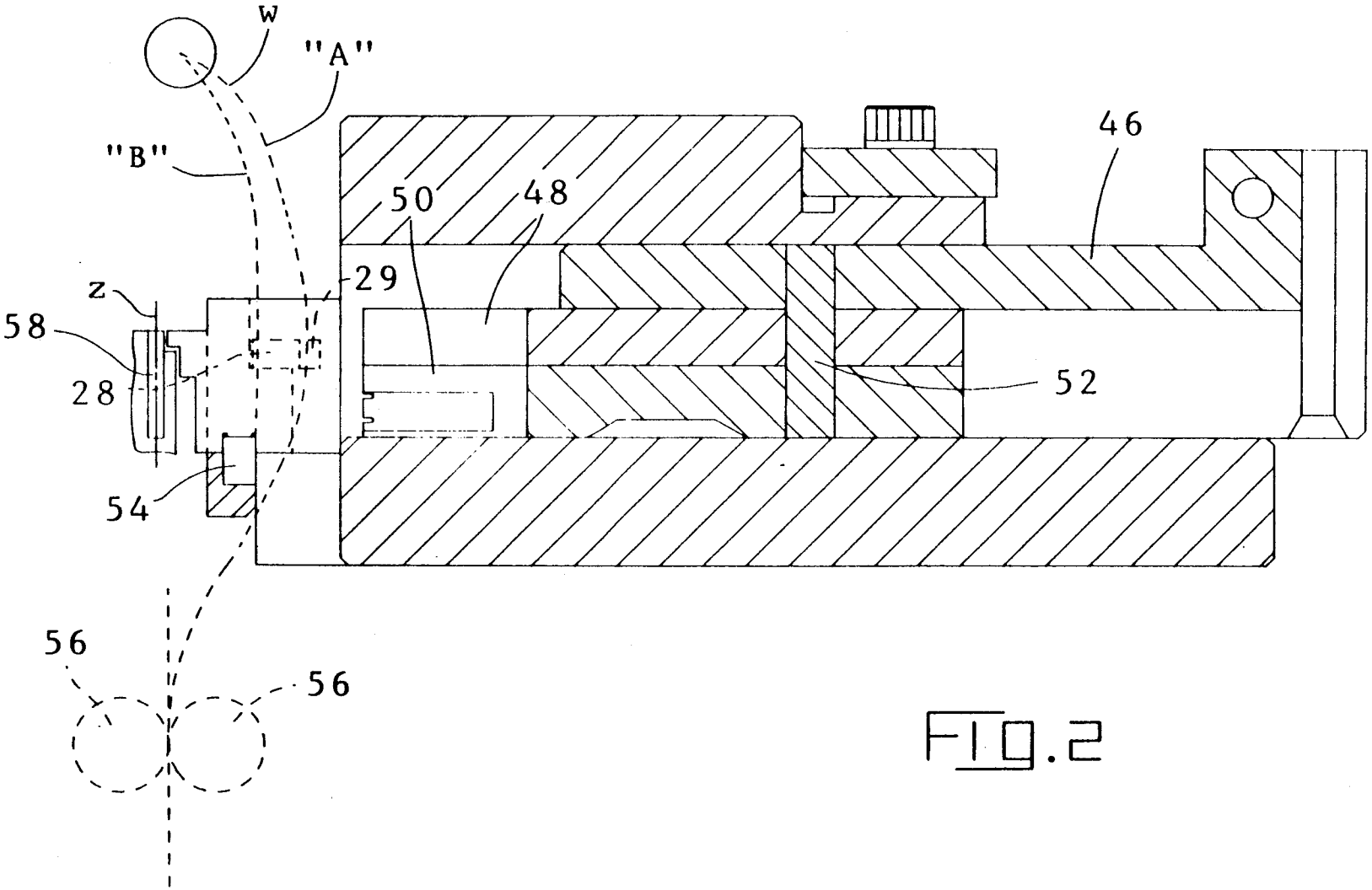
FIG. 2 is a cross-sectional view taken along section 2—2 of FIG. 1.
Figure 4:
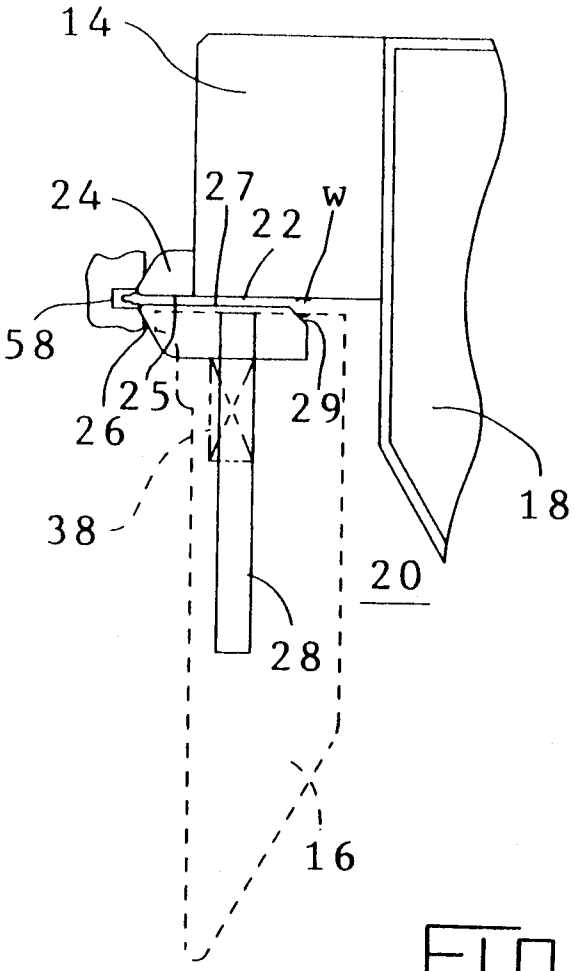
FIG. 4 is a view corresponding, generally, to that of FIG. 1 showing, however, only the outermost portion of the appendage and platform.
Figure 3:
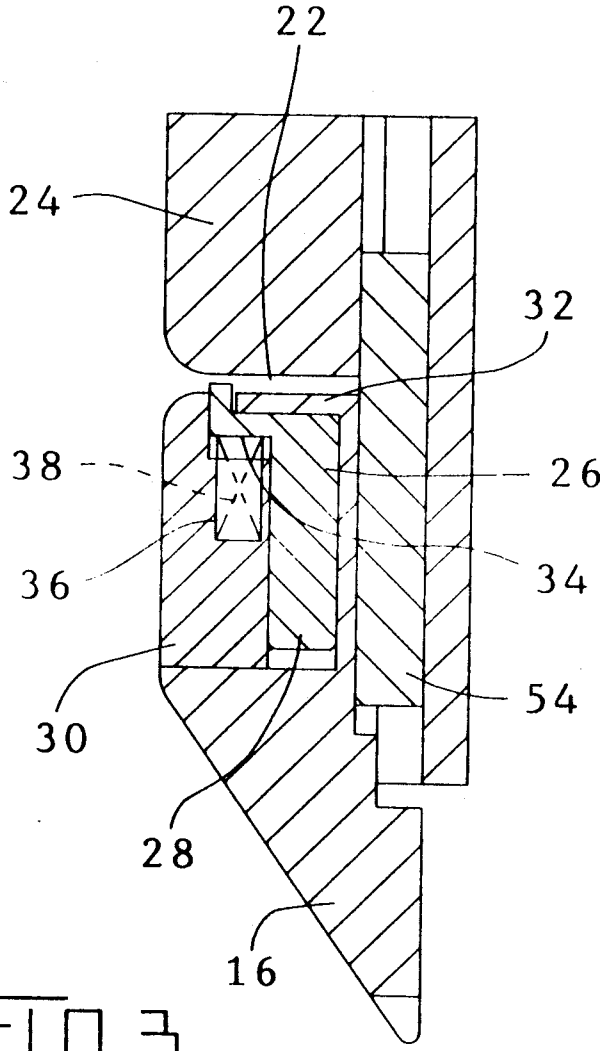
FIG. 3 is a cross-sectional view taken along section 3—3 of FIG. 1.

The platform 12 has a trough 44 along which an inserter housing 46 translates. The housing 46 confines and carries a wire guiding blade 48 and an inserter 50. Both are secured to the housing 46 by means of a key 52. By means described in the U.S. Pat. Nos. 4,470,181 and 4,238,874, the housing 46 is advanced toward the appendage 14 and, as a consequence thereof, the blade 48 and inserter 50 engage a wire W held in the channel 22 and move it lengthwise of the channel toward its designated contact. With particular reference to FIGS. 2 and 4, it will be appreciated that the wire W has been held at the entrance to the channel 22, against a knee 29 of the spring-biased guide 26 by the tension of the friction drive rollers 56, as well as against a lowermost land below the shear 54. The wire describes a relatively arcuate loop "A" into the channel 22, and has a somewhat taut lie thereafter to the tensioning rollers 56. This arcuate loop "A" is important in the operation of the device because a small amount of slack is provided in the wire W. As the blade 48 and inserter 50 engage the wire, they cause it to force the spring-biased guide 26 to retract and open the channel to the wire width. At this point, the drive rollers somewhat release their grip on the wire W thereby reducing some of the tension on the wire. Due to the slack in the wire W, tension must necessarily be further reduced as the wire moves to the position indicated as B in FIG. 2 and is aligned with the axis Z of the terminal 58 as it advances toward the shear 54. This reduction in tension of the wire W tends to prevent the wire W from moving in an axial direction away from the shear 54. In view of these circumstances, the guides 26 and 24 impose a movement-retarding force or drag on the wire as it traverses the channel before the blade 48 and inserter 50. As a result of this drag the wire W comes into pressing engagement with the blade advancing and inserter 50 thereby assuring controlled movement through the channel 22. This drag and the presence of a small amount of slack also help to prevent axial movement of the wire after severing by the shear 54. As movement continues the wire W is then severed, and the terminated end which has been pushed between the guides 26 and 24 throughout the travel of the wire through the channel, is inserted into the contact 58 of the connector half (not shown).

While we have described our invention in connection with a specific embodiment thereof, it is to be clearly understood that this is done only by way of example, and not as a limitation to the scope of the invention as set forth in the objects thereof and in the appended claims.

We claim:

1. In a wire trimming and inserting machine for inserting a wire into a connector terminal, an insertion head comprising:

a platform;

wire receiving and guide means coupled to said platform for defining a variable-width channel and for receiving wire therewithin and guiding such wire in movement through said channel including a pair of guides, one of which is rigidly coupled to said platform and the other being movable relative thereto; and a resilient means for urging said other guide toward said one guide, wherein said guides have mutually opposed linear surfaces which define sidewalls of said channel; and means for moving a wire through said channel in a direction substantially lateral to the longitudinal axis of said wire and into engagement with said terminal; wherein said wire receiving and guide means imposes a movement-retarding force of drag on said wire during movement thereof in said channel.

2. An insertion head, according to claim 1 wherein:

said wire receiving and guiding means further comprises a guideway formed in an underlying member coupled to said platform; and said other, movably mounted guide is slidable within said guideway.

3. An insertion head according to claim 2 wherein said means for moving said wire through said channel is arranged to move said wire in a direction lateral to the longitudinal axis of said wire.

4. In a wire trimming and inserting machine for inserting a wire into a connector terminal, an insertion head comprising:

a platform;

an appendage coupled to said platform; wherein said appendage has a channel formed therein for receiving wire for movement therewithin and guiding such wire during said movement through said channel from a first position to a second position, said movement being substantially lateral to the longitudinal axis of said wire inserter means for effecting said movement of said wire in said channel; and means coupled to said appendage for imposing a movement-retarding force or drag on said wire during said movement thereof in said channel between said first and second positions.

5. In a wire trimming and inserting machine for inserting a wire into a connector terminal having an axis, an insertion head comprising:

a platform;

an appendage coupled to said platform, wherein said appendage has a channel formed therein for receiving wire therewithin and guiding such wire in movement thereof through said channel from a first position in said channel in which a portion of said wire is of arcuate shape through a second position in said channel in which said portion of said wire is substantially parallel to said axis of said terminal; and means coupled to said appendage for (a) moving said wire through said channel in a direction substantially lateral to the longitudinal axis of said wire from said first position through said second position, and (b) imposing a movement-retarding force or drag on said wire during said movement of said wire through said channel.

6. The insertion head according to claim 5 wherein said channel formed in said appendage includes first and second substantially parallel and opposed surfaces, said first surface being stationary with respect to said appendage and said second surface being movable with respect thereto.

7. The insertion head according to claim 6 wherein said means for imposing a movement-retardinq force or drag on said wire includes a resilient member for urging said movable second surface toward said first surface.

8. The insertion head according to claim 5 wherein said means for moving said wire through said channel is arranged to move said wire from said first position where said wire is free of said movement-retarding force or drag, into engagement within said channel where said wire is affected by said movement-retarding force or drag.

9. The insertion head according to claim 5 including means for tensioning said wire, means for trimming said wire, and means for releasing said tension from said wire prior to trimming thereof.

* * * * *